United States Patent [19]

Hughes

[11] 4,060,150

[45] Nov. 29, 1977

[54] LADDER KIT

[76] Inventor: Peter Hughes, 33 Lower Park, Putney, SW. 15, London, England

[21] Appl. No.: 706,621

[22] Filed: July 19, 1976

Related U.S. Application Data

[63] Continuation-in-part of Ser. No. 503,623, Sept. 6, 1974, abandoned.

[30] Foreign Application Priority Data

Sept. 7, 1973 United Kingdom ..... 42189/73

[51] Int. Cl.[2] ..... E06C 7/08; E06C 1/08

[52] U.S. Cl. ..... 182/151; 182/27; 182/178; 182/194; 182/206; 182/228

[58] Field of Search ..... 182/27, 194, 228, 151, 182/178, 219, 118

[56] References Cited

U.S. PATENT DOCUMENTS

| | | | |
|---|---|---|---|
| 247,416 | 9/1881 | Row | 182/194 |
| 1,228,248 | 5/1917 | Rudd | 182/228 |
| 2,261,956 | 11/1941 | Brownlie | 182/228 |
| 2,473,388 | 6/1949 | Rambo | 182/178 |
| 2,900,041 | 8/1959 | Leavitt | 182/178 |
| 3,119,435 | 1/1964 | Greenman | 182/228 |
| 3,476,211 | 11/1969 | Cormier | 182/178 |

*Primary Examiner*—Reinaldo P. Machado
*Attorney, Agent, or Firm*—Eric P. Schellin

[57] ABSTRACT

A ladder kit comprises a plurality of parts from which a ladder may be constructed. The parts of the kit may be selected and assembled in a number of ways, resulting in various types of ladder structures. The main components of the assembled ladders include elongated tubular side rail sections and rectangular frame sections. The frame sections fasten the side rail sections into coplanar pairs and form the rungs of the ladder.

10 Claims, 14 Drawing Figures

FIG. 4.
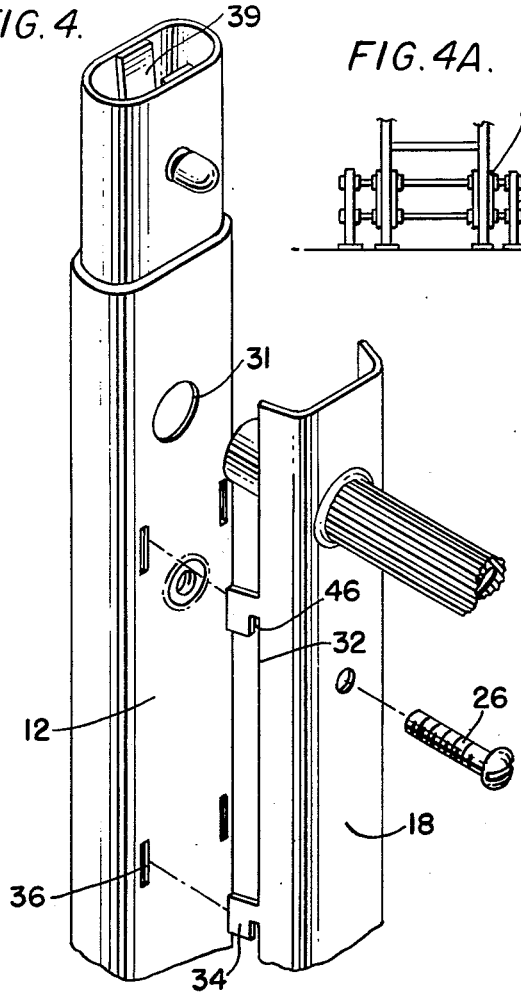
FIG. 4A.
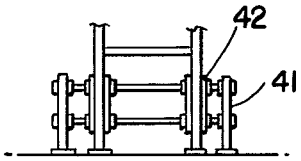
FIG. 5.
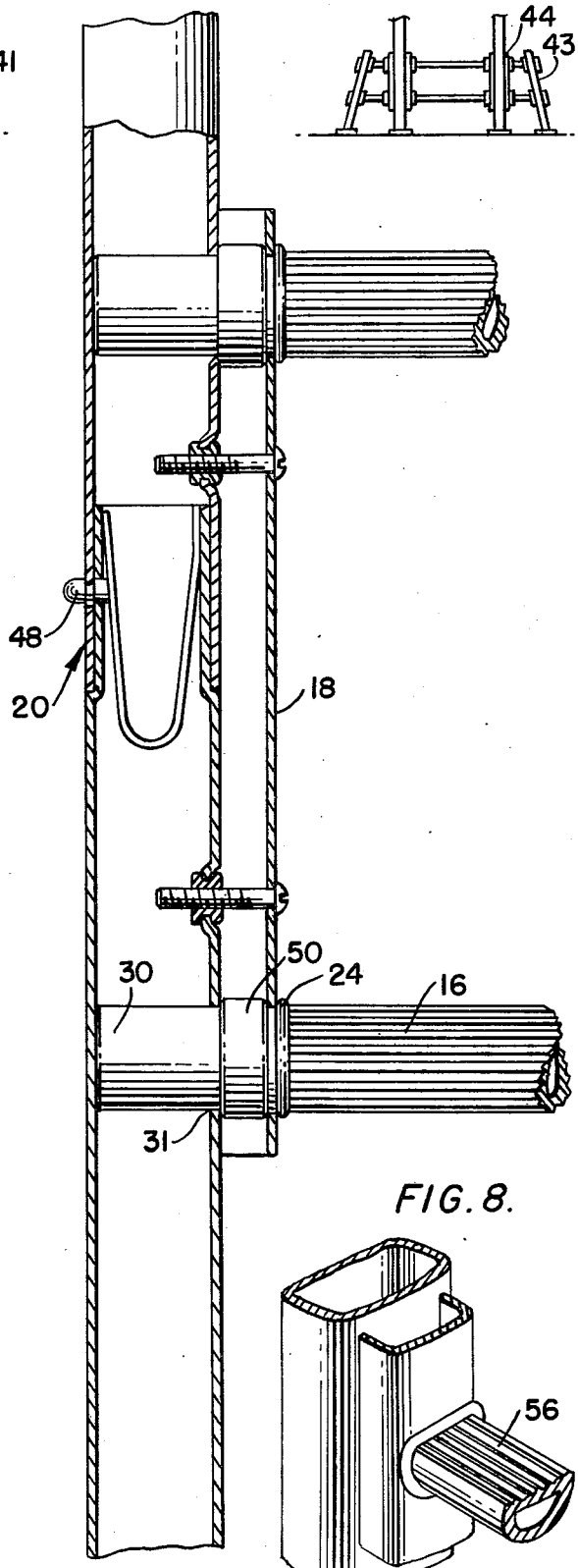
FIG. 4B.
FIG. 6.
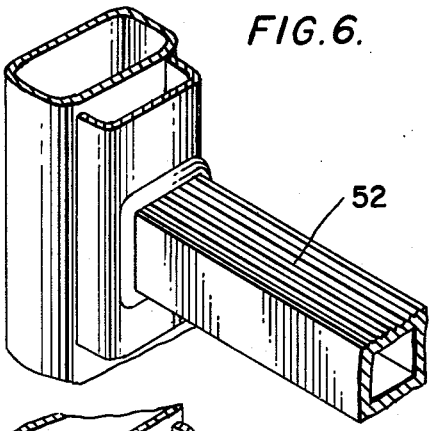
FIG. 7.
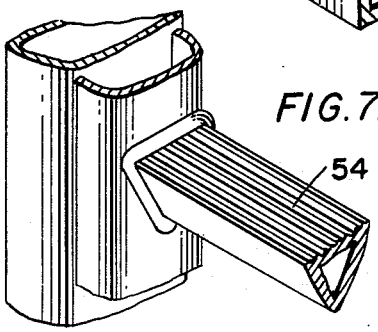
FIG. 8.
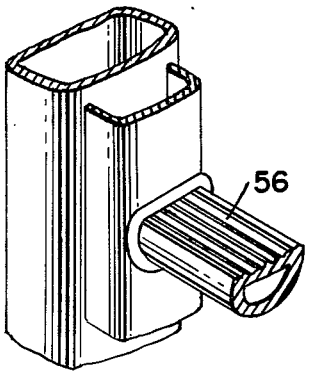

LADDER KIT

This is a continuation-in-part of application Ser. No. 503,623, filed Sept. 6, 1974 and now abandoned.

BACKGROUND OF THE INVENTION

The invention relates to a ladder kit comprising a plurality of parts from which ladder structures may be made. Elongated tubular members interfit end-to-end to form the side rails of a ladder. Rectangular frame members fasten the side rails into coplanar pairs and form the rungs of a ladder.

There is a need for a ladder which may be assembled from lightweight parts or sections. The sections should be able to be assembled in a variety of ways to produce a ladder device which is suited to one of a number of particular uses. The assembly of the parts should be simple and require only a minimum number of tools, yet the assembled structure should be strong and sturdy. Disassembly of the parts should be simple so that the parts may be stored in a minimum amount of space until a ladder type device is needed again.

SUMMARY OF THE INVENTION

The invention presents a ladder kit from which a ladder may be made. Elongated tubular members interfit and lock end-to-end to form side rails of a completed ladder structure. The side rails are constructed to receive fastening devices which secure rectangular frame members thereto. When assembled, the side rails are oriented in parallel pairs and the frame members form the rungs of a ladder extending therebetween.

The parts of the kit may be assembled in a variety of ways to produce a ladder which is especially suited to a particular use. Accordingly, a ladder may be formed having a single course of parallel side rails and a plurality of rungs extending therebetween. Alternatively, a step ladder may be formed having two pairs of side rails which are angularly related. The angularly related rail pairs may be joined by a bridging structure so that a device suitable for use as a scaffold is formed. As a further alternative, the angularly related rail pairs may be of unequal length so that the assembled ladder may be used on stairs. A single pair of side rails joined by frame members may be assembled with a hooked end enabling the ladder to be secure in an upright position against an elevated horizontal pole or branch.

It is therefore an object of this invention to provide a kit of parts from which a ladder may be assembled.

It is a further object of this invention to provide a kit of elongated tubular members forming side rails and frame members forming rungs.

It is a yet further object of this invention to provide a kit of tubular members and frame members which may be assembled in a variety of ways to produce a ladder suited to a particular purpose.

It is another object of this invention to provide a ladder kit from which a simple ladder, a step ladder, a scaffold structure, or a ladder of unequal length sides may be assembled.

These and other objects of the invention will be apparent from the following specification given by way of example only and taken in conjunction with the accompanying drawings.

BRIEF DESCRIPTION OF THE DRAWINGS

FIG. 4 shows a perspective view of a frame element and its manner of fastening to a side rail element.

FIGS. 4A and 4B show attachments for a ladder for widening the base portion thereof.

FIG. 5 shows a sectional view of an alternate manner of assembling side rails and a frame member together.

FIGS. 6, 7, and 8 show various forms of frame member rungs according to the invention.

DESCRIPTION OF THE PREFERRED EMBODIMENT

Figure 1:
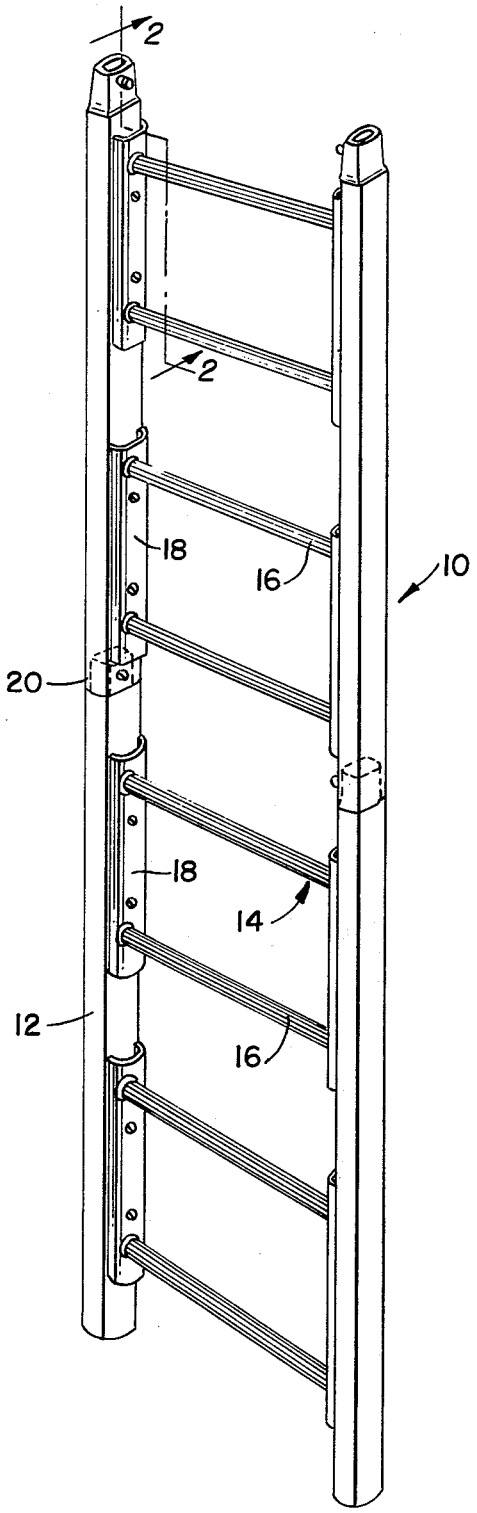
FIG. 1 shows a perspective view of one form of a ladder of the present invention.

Turning now to FIG. 1 there is shown an assembled section of a ladder 10. The ladder comprises a plurality of elongated tubular members 12 which are fastened together in parallel pairs by frame members 14 to form a module. The frame members include rungs 16 which are fastened to rung holder brackets 18. It can be seen that the parallel pairs of tubular members form side rails of a ladder which interfit in an end-to-end relationship as shown at 20. The tubular members themselves are shown having a cross-sectional shape which is best described as a flattened oval. Of course, other shapes such as square, round, or oval may also be used. Additionally, while the frame members are shown here as comprising only two rungs. more than two rungs may be used. It then becomes possible to construct a module comprising two side rails and a single frame member where the frame member includes four rungs. Frame members could be constructed so that the side rails, when fastened together thereby, would not be parallel but converging slightly. Of course, other combinations of rungs and frame members per module are possible.

Figure 2:
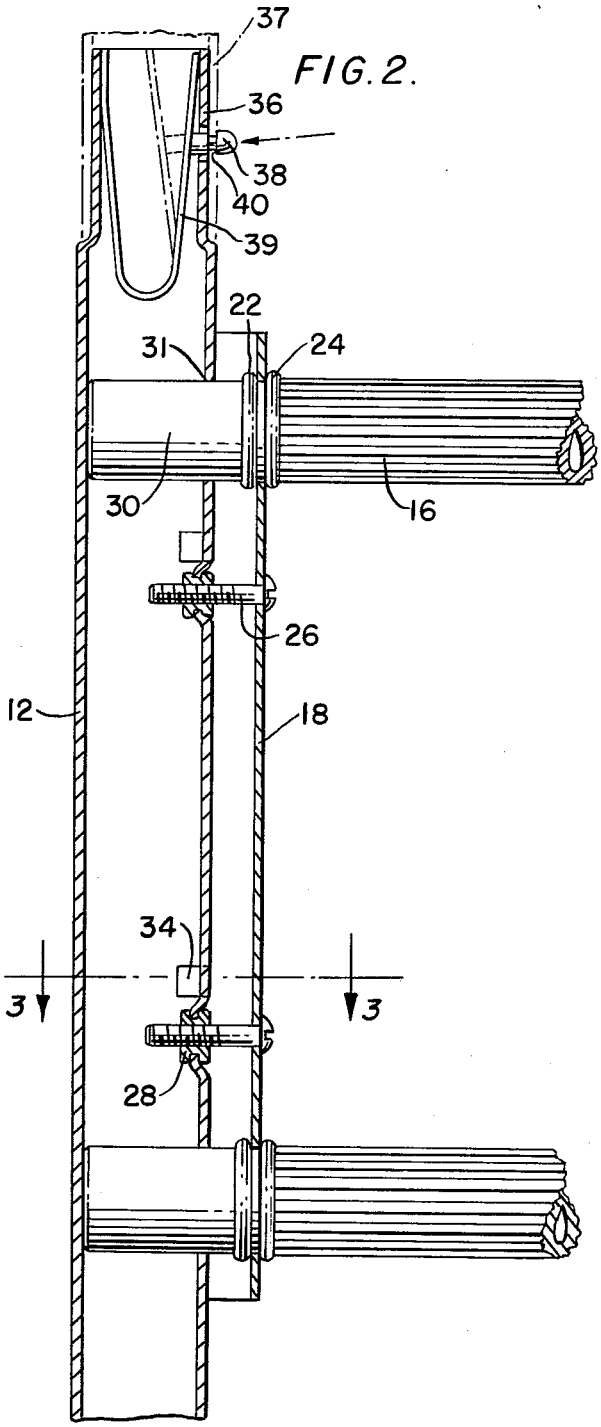
FIG. 2 shows a sectional view taken along line 2—2 of FIG. 1 showing the structure of the fastening of the several ladder components.

Turning to FIG. 2, the fastening of the rung holder brackets 18 to the side rails 12 and the fastening of the individual rungs 16 to the rung holder brackets 18 can be seen with greater particularlity. Beads 22 and 24 formed on the rung 16 secure the rung to the bracket 18. These beads may be formed, for example, by brazing or by a mechanical forming operation as is appropriate. The bracket 18 is fastened to rail 12 by screws 26 which thread into bushings 28 which are mechanically fastened, as by a deforming operation, to an aperture in the rail 12. In the assembled position, the end 30 of the rung 16 passes through an aperture 31 and abuts the interior surface of the rail. It will be appreciated that the screws 26 draw the edge 32 of the rung holder bracket 18, best seen in FIG. 4, tightly against the surface of rail 12. Also, the end 30 of the rung is drawn against the inside of the rail creating a very rigid structure. In FIG. 4 are shown the ears 34 on the bracket 18 which mate with the slots 36 to aid in correctly locating the frame member on the side rail.

FIG. 2 additionally shows in detail the reduced end 36 of the side rail. Shown in broken lines is the full size end 37 of an adjacent rail end which telescopes over the reduced end. This reduced end may be formed by a swaging operation which is suitable where the flattened oval shaped tubing is used, or where a square, round, or triangular shaped tubing is used. A button 38 is urged by a U-shaped spring 39 to pass through and engage an aperture in rail end 37. This button 38 is formed with a shoulder 40 which acts to lock the button against withdrawal from the overfitting rail end. A non-shouldered button, or a peg or screw, could also be used. If desired, rather than swaging a rail end to reduce its size, an insert which would closely fit into the ends of the side rails could be employed.

Figure 3:
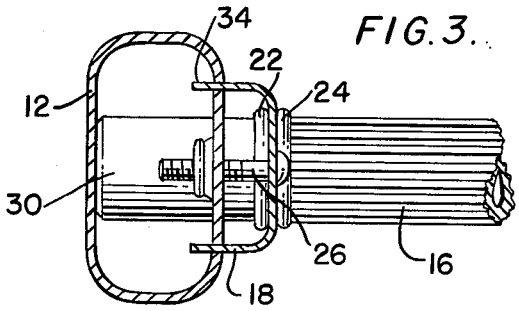
FIG. 3 shows a sectional view taken along line 3—3 of FIG. 2.

Turning now to FIG. 3, the penetration of the ear 34 into the slot 36 on rail 12 can be seen. In conjunction with FIG. 4, it will be seen that this ear includes a slot 46 which engages the walls of the rail adjacent the slot 36 to prevent an inadvertent withdrawal therefrom. Owing to the method of attachment of the frame members to the side rails, the ears may be omitted without reducing the strength of the assembled ladder.

FIG. 4A shows an attachment for the base portion of the ladder. The attachment comprises a short section 41 of side rail tubing which attaches to the base of a ladder structure by means of a bracket 42. This bracket is similar in construction to the bracket 18 which forms, with a pair of rungs 16, a frame member 14. The bracket 42 attaches to the ladder in a manner similar to the attachment of bracket 18 to the side rails 12 as detailed above. It will be readily appreciated that the attachment widens the base of the ladder and inherently gives greater stability thereto. As shown, the sections 41 are generally parallel to the side rails of the ladder to which they are attached.

FIG. 4B shows an alternate form of the attachment of FIG. 4A wherein sections 43 are fastened to the base of a ladder by brackets 44. These sections are angled with respect to the side rails of the ladder to which they are attached. The brackets 44 are similar to the rung holder brackets 18 described above. The attachment could take other forms as would be apparent to one skilled in the art.

Considering now FIG. 5, an alternative construction is shown where the rung bracket 18 spans the junction 20 of two adjacent rail ends. In this construction, the button 48 is directed toward the outside edge of the assembled ladder structure so that its access will not be blocked by the bracket 18. The construction is further modified by the provision of a circular boss 50 which performs two functions. This boss, together with the bead 24, secures the rung 16 to the rung holder bracket 18 and additionally abuts the facing edge of the side rail 12. Three separate areas of pressure act to maintain the assembled structure rigid using this construction. Edge 32 abuts the side of rail 12, end 30 of the rung abuts the inside surface of the rail, and boss 50 bears against the rail in that area immediately surrounding the aperture 31.

FIGS. 6, 7 and 8 show alternative forms for the rung 16, which in the previous Figures is shown as round. Rung 52 of FIG. 6 is square in cross-section and is ribbed along that surface which would ordinarily support the foot of a user. Rung 54 of FIG. 7 is triangular in cross-section. Rung 56 is D-shaped in cross-section with the flat part of the D being ribbed to receive the foot of a user. Of course, the entire outer surface of any of the rungs shown may be ribbed or formed with any pattern which would enhance the non-slip characteristics thereof. While the rungs are shown as being hollow, solid rungs are also within the scope of this invention.

Figure 9:
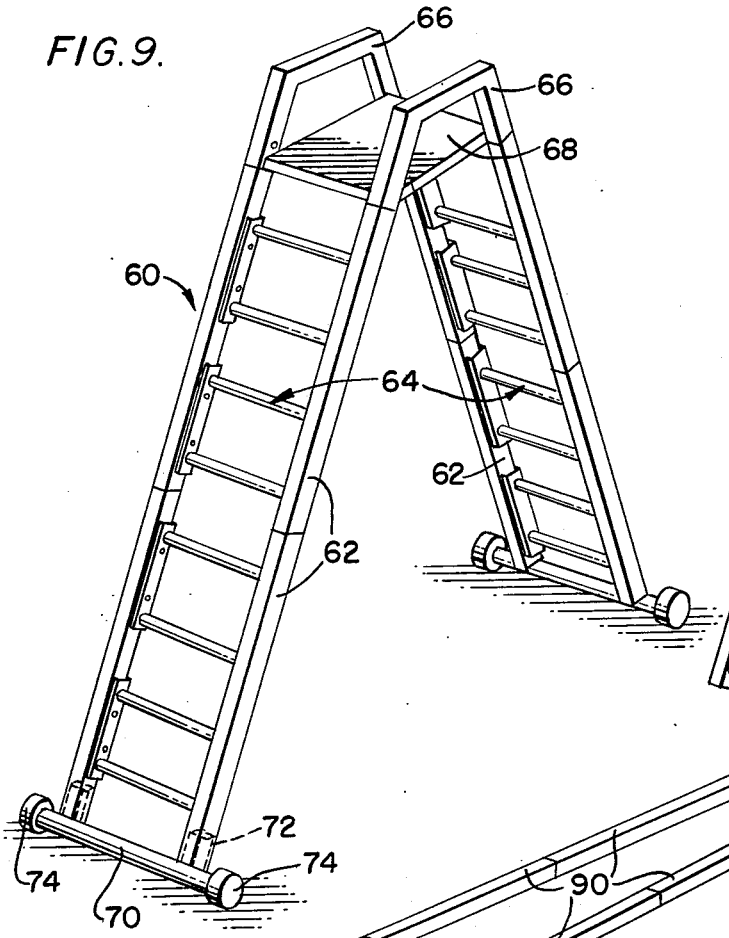
FIG. 9 shows a step ladder assembled from the ladder parts.

Referring now to FIG. 9, there is shown an alternate ladder construction 60 comprising eight side rail members 62 and eight frame members 64. Four rail members and four frame members form one side of a step ladder while the remaining elements form the other side. Two bridge pieces 66 connect the two sides together and a platform 68 may be provided to give a work supporting surface. The lower ends of the assembled ladder sides include a foot section 70. This section telescopes into the open ends of the lower side rails 62 by means of reduced stubs 72 and creates a widened base for the ladder giving greater stability. The ends of foot section 70 are covered by boots 74 of non-slip non-marring material such as rubber or the like. This foot section may be used on any of the embodiments of the invention described herein.

Figure 10:
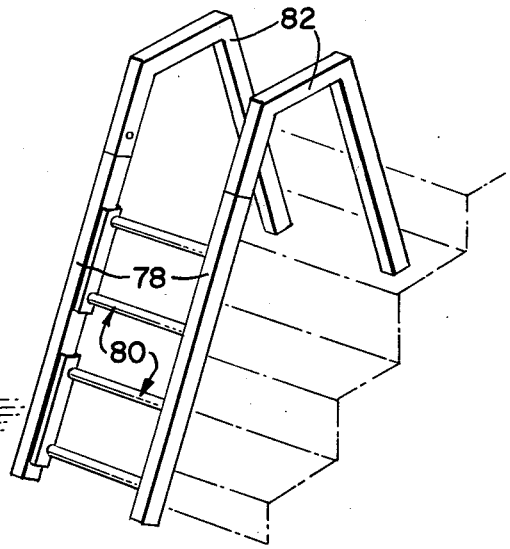
FIG. 10 shows a step ladder having unequal length sides for use on stairs.

Referring now to FIG. 10, there is shown a ladder section 76 comprising two side rails 78 and two frame sections 80. The ladder is adapted for use on stairs by means of two J-shaped extensions 82. Of course it will be appreciated that the specific embodiment shown is given as being exemplary only, and that other constructions are within the purview of this invention. For instance, more than two side rail sections can be used to form the long side of the ladder. Frame members may be used on the J-shaped extensions to rigidify them and provide additional rungs when desired.

Figure 11:
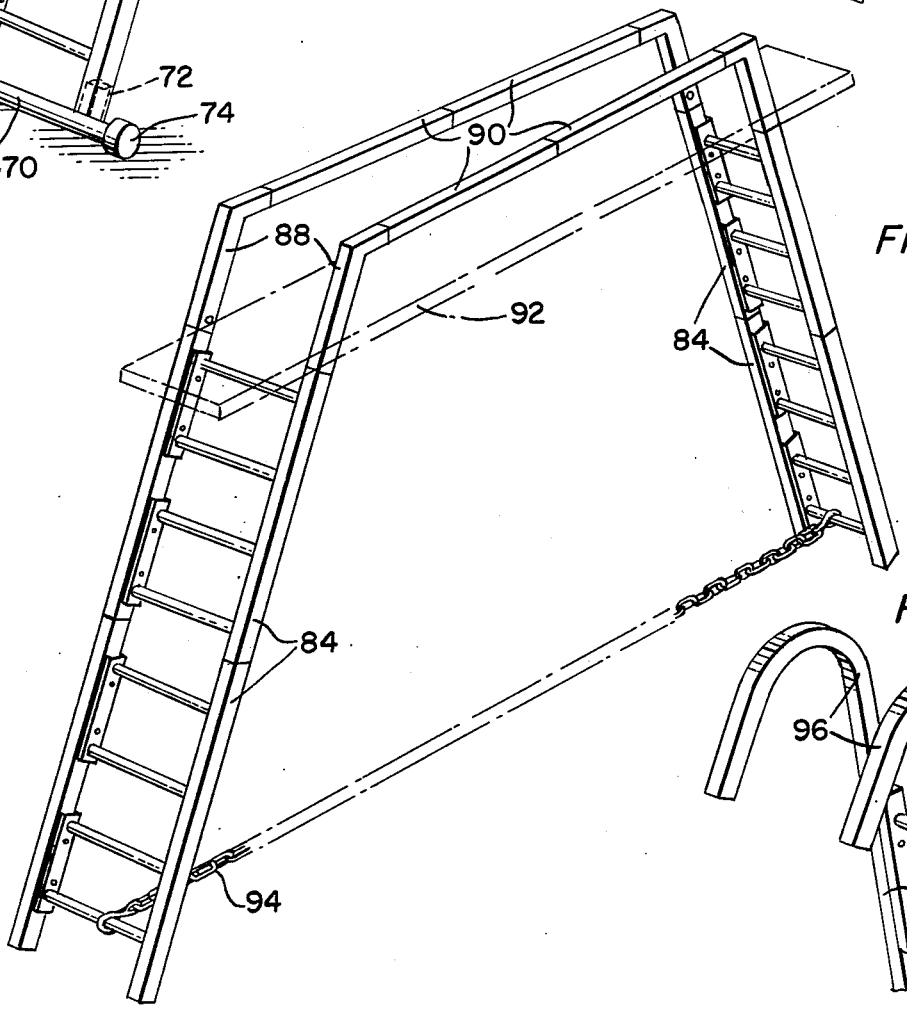
FIG. 11 shows two step ladder halves joined by a bridging structure allowing a scaffold to be formed.

Turning now to FIG. 11, an embodiment is shown whereby the ladder assembly may be used as a scaffold. A plurality of side rails 84 and frame members 86 are joined to form two ladder sections. These sections are then connected by means of angular members 88 and straight members 90 to space the tops of the ladder sections one from the other. The inclusion of a section of planking 92 provides a scaffold structure. To further reinforce the assembly and prevent the outward splaying of the ladder section, a tension member 94 such as a chain or cable may be provided. This tension member is attached to the ladder sections as at the bottom rungs or in any other manner which will be apparent to one skilled in the art. If desired, the angular member 88 could be made in the form of a right angle. In certain instances, the tension member 94 could be eliminated.

Figure 12:
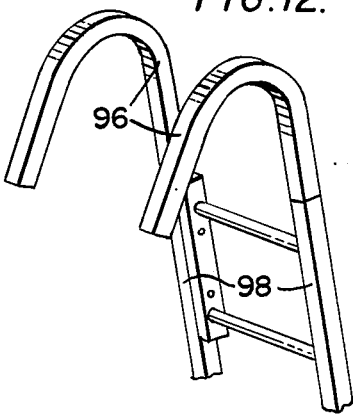
FIG. 12 shows a ladder having a hooked top end.

The embodiment of FIG. 12 shows U-shaped extentions 96 positioned on the ends of side rails 98. These U-shaped extensions enable the end of the ladder to be hooked over a horizontal pole or branch and minimizes the possibility of the ladder slipping therefrom. This extension 96 could also take the form of a pair of straight members hinged together so that a desired angular relationship between the members could be effected.

In the invention as described above, while the selection of materials used in the construction of the ladder would be within the skill of one versed in the art, a lightweight metal such as aluminum or a similar alloy is preferred. Although not specifically shown on the drawings, all extensions and attachments to the side rail members, other than the frame members, are made secure through the use of the button connectors as best shown in FIGS. 2 and 5.

It should be understood that while the description above is in clear and exact terms, that various departures and modifications may become apparent, and that such departures and modifications are within the purview of my invention as defined in the appended claims.

I claim:

1. In a ladder comprising a plurality of interfitting parts which are adapted to be readily disassembled;

a plurality of elongated tubular elements, at least one frame member, said frame member fastening by means of threaded fastening elements said tubular elements into a parallel pair of side rails of said ladder, said frame member comprising a pair of rung holder brackets having a surface edge which abuts said side rail, wherein said fastening elements pass through said brackets and into said side rails, and wherein said rungs are fixed in said brackets and are received by second apertures in said side rails.

2. The ladder of claim 1 wherein said side rails include third apertures and said brackets include ears which are received by said third apertures, and said rung passing through said second apertures has an end which abuts an interior surface of said side rail.

3. The ladder of claim 1 wherein said ladder comprises a plurality of modules assembled end-to-end, each module comprising a pair of side rails and a pair of frame members, each frame member comprising a pair of rungs, the ends of the side rails on one end of said module being reduced to fit into the side rail ends of the adjacent module, and a button urged by a spring passes from said reduced end into an overfitting end of an adjacent side rail to prevent the separation thereof.

4. The ladder of claim 1 wherein beads of material fix said rungs in said brackets, one of said beads abutting one side of said bracket adjacent said first aperture, and a second of said beads abutting a second side of said bracket adjacent said first aperture, the second bead also abutting said side rail adjacent said second aperture.

5. A ladder comprising a plurality of interfitting parts, which are adapted to be readily disassembled, the parts comprising at least two modules, each module comprising a pair of elongated tubular elements forming side rails and a plurality of demountable frame members mounted to the tubular elements, each frame member being rectangular and comprising a pair of rungs, the side rails at one end of each module having a reduced end to mate with the ends of the side rails of an adjacent module, and a connecting element joining at least two modules together, the joined modules defining two distinct planes which intersect in a line above the connecting element.

6. The ladder of claim 5 wherein said connecting element includes a bridging piece, said bridging piece spacing said connected module ends remote from one another, wherein said ladder includes a flexible and windable tension element connecting together said module ends opposite said module ends opposite said bridging piece.

7. A ladder for use on a surface which is not level, said ladder comprising, at least one module having first and second ends, said module comprising a pair of side rails and a pair of frame members, each frame member having two rungs, a pair of J-shaped attachment members having first and second ends, the first ends of said modules being coupled to the first ends of said attachment members, wherein the distance from the second ends of the module to the top of the ladder is greater than the distance from the second ends of the attachment members resting on said surface to the top of the ladder.

8. The ladder of claim 3 including an attachment member for widening the base thereof, said attachment comprising a pair of side rail sections and a pair of brackets, said brackets fastening said side rail sections to the ladder in a plane which is common to the ladder side rails and the attachment.

9. The ladder of claim 8 wherein said side rail sections are parallel to one another and to said ladder side rails.

10. The ladder of claim 8 wherein said side rail sections are angled with respect to said ladder side rails.

* * * * *